US008584662B2

(12) United States Patent
Whitehead

(10) Patent No.: US 8,584,662 B2
(45) Date of Patent: Nov. 19, 2013

(54) APPARATUS AND SYSTEM FOR CUTTING FIBER-CEMENT MATERIALS AND METHODS OF OPERATION AND USE

(75) Inventor: John T. Whitehead, Lake Tapps, WA (US)

(73) Assignee: PacTool International, Kingston, WA (US)

( * ) Notice: Subject to any disclaimer, the term of this patent is extended or adjusted under 35 U.S.C. 154(b) by 480 days.

(21) Appl. No.: 12/690,010

(22) Filed: Jan. 19, 2010

(65) Prior Publication Data

US 2010/0218753 A1 Sep. 2, 2010

Related U.S. Application Data

(60) Provisional application No. 61/145,494, filed on Jan. 16, 2009.

(51) Int. Cl.
*B28D 1/22* (2006.01)

(52) U.S. Cl.
USPC ..... 125/23.01; 125/36

(58) Field of Classification Search
USPC ..... 125/23.01, 23.02, 24, 15, 18, 36, 16.04; 83/425.3
See application file for complete search history.

(56) References Cited

U.S. PATENT DOCUMENTS 2,900,178 A * 8/1959 Harrison et al. ..... 299/100
7,243,646 B2 * 7/2007 Todack ..... 125/23.01

* cited by examiner

*Primary Examiner* — Dung Van Nguyen
(74) *Attorney, Agent, or Firm* — Perkins Coie LLP

(57) ABSTRACT

Apparatus and methods of processing fiber-cement workpieces to form fiber-cement shake panels. One embodiment of such a method comprises positioning a cured fiber-cement workpiece over an anvil plate having at least one slot and driving a cutting blade along a straight, vertical path to pass a cutting edge of the cutting blade through the workpiece. The process can optionally include coating the fiber-cement panels before installing the fiber-cements panels on a wall.

18 Claims, 9 Drawing Sheets

APPARATUS AND SYSTEM FOR CUTTING FIBER-CEMENT MATERIALS AND METHODS OF OPERATION AND USE

CROSS-REFERENCE TO RELATED APPLICATIONS

This application claims the benefit of U.S. Provisional Patent Application Ser. No. 61/145,494, filed on Jan. 16, 2009, and entitled "APPARATUS AND SYSTEM FOR CUTTING FIBER-CEMENT MATERIALS AND METHODS OF OPERATION AND USE," which is hereby incorporated herein in its entirety by reference.

TECHNICAL FIELD

This technology generally relates to cutting machines and knife/die apparatus for cutting fiber-cement materials to form, for example, shake-panel siding used on or in houses and other structures.

BACKGROUND

The exterior surfaces of houses and other structures are often protected by exterior siding products made from wood, vinyl, aluminum, bricks, stucco, fiber-cement and other materials. Wood and fiber-cement siding (FCS) products, for example, are generally planks, panels or shakes that are attached to plywood or composite walls. Although wood siding products are popular, wood siding can become unsightly or even defective because wood generally rots, warps or cracks over time. Wood siding products are also highly flammable and subject to insect damage. FCS is an excellent alternative building material because it is nonflammable, weatherproof, relatively inexpensive to manufacture, and does not use the limited remaining cedar or fir resources. FCS also does not rot, nor is it consumed by insects.

FIG. 1 shows a prior art fiber-cement shake-panel 20 having a length L extending along a longitudinal direction and widths $W_1$ and $W_2$ extending along a direction transverse relative to the length L. The shake-panel 20 has side edges 23 separated from each other by the longitudinal direction, a top edge 22 extending along the longitudinal dimension between the upper ends of the side edges 23, and a bottom edge 24 extending along the longitudinal dimension between the bottom ends of the side edges 23. The top and bottom edges 22 and 24 are typically substantially parallel to each other and separated by a constant widthwise dimension or varying widthwise dimensions (e.g., $W_1$ or $W_2$). The shake-panel also includes a web portion 32 and a plurality of shake sections 30*a* and 30*b* of different lengths $L_{s1}$ and $L_{s2}$ projecting from the web portion 32. The individual shake sections 30*a* and 30*b* are separated by slots 28 such that the shake sections 30*a* and 30*b* have various widths corresponding to the distance between adjacent slots 28.

FIG. 2 illustrates an early prior art cutting machine 34 suitable for forming the shake-panel 20 shown in FIG. 1. Referring to FIG. 2, the cutting machine 34 includes a frame 36, a plurality of cutting stations 35*a*-35*d*, and a plurality of rollers 58 for supporting and advancing a sheet of fiber-cement to be cut. The cutting stations 35*b* and 35*c* are configured to cut the slots 28 shown in the shake panel 20 of FIG. 1. The cutting station 35*b* includes a slot cutting assembly 53 having a blade holder 54, a plurality of cutting blades 56 attached to the blade holder 54, and an actuator 60 for driving the blade holder 54 along rotational path $R_1$. Each cutting blade 56 is configured to cut an individual slot 28 shown in the shake panel 20. The blade holder 54 is pivotally connected to the frame 36 such that the actuator 60 moves the blade holder 54 along the rotational path $R_1$ between a cutting position (lowered position not shown in FIG. 2) and a retracted position (raised position shown in FIG. 2). The cutting station 35*c* includes a cutting assembly 63 having a blade holder 62 pivotally connected to the frame, a plurality of slot cutting blades 64 attached to the blade holder 62, and an actuator 60 coupled to the blade holder 62 and the frame 36 to rotate the cutting assembly 63 along another rotational path $R_2$.

FIG. 3 illustrates a cutting assembly 63*a* used in a later cutting machine described in U.S. patent application Ser. No. 11/371,452 filed on Mar. 8, 2006, which is incorporated herein by reference in its entirety. The cutting assembly 63*a* includes a blade holder 62*a*, a plurality of cutting blades 64*a* attached to the blade holder 62*a*, and a lower anvil 70 with a plurality of slots 72 configured to receive respective cutting blades 64*a*. In operation, a fiber-cement workpiece (not shown) is gripped between rollers 58*a* and drive belts 59 that move the workpiece along a path P until the workpiece is positioned at a desired location between the cutting blades 64*a* and slots 72. An actuator (not shown in FIG. 3) rotates the workpiece holder 62*a* downwardly as indicated by arrow R so that the cutting blades 64*a* pass through the fiber-cement workpiece and into corresponding slots 72. The rollers 58*a* and/or the belts 59*a* then drive the workpiece along the path P to withdraw the workpiece from the cutting blade 64*a*, and then the actuator rotates the workpiece holder 62*a* upwardly into the position illustrated in FIG. 3.

PacTool International, Ltd. (PacTool), the assignee of the present invention, developed the cutting machines shown in FIGS. 2 and 3. Although the existing cutting machines illustrated in FIGS. 2 and 3 are suitable for forming the shake-panel 20 illustrated in FIG. 1, they required a significant amount of maintenance that increased the operating cost. For example, the shape of the cutting blades 64*a* and the rotational motion of the blade holder 62*a* required a significant amount of force to drive the cutting blades through the fiber-cement workpiece. This generally caused a sudden fracture in the fiber-cement workpiece that would in turn transmit significant impact forces to the lower plate 70, the blade holder 62*a* and the frame 36. The impact forces were so great that welded connections between members of the frame 36 cracked and broke apart, and other parts of the machine would wear quickly. Therefore, PacTool sought to improve the longevity of the cutting machine.

In addition to the high operational costs of the existing cutting machines, the fiber-cement industry is moving toward pre-painted shake-panel products in which the shake-panels are painted or stained at a manufacturing site before they are shipped to a distributor and installed. The shake-panels are painted or stained in a manner in which particles or dust remaining on the cut shake-panels can foul the paint and/or the painting equipment. This can increase maintenance costs and downtime for the painting equipment and reduce the quality of the finished coat of paint. The cutting blades 56, 64 and 64*a* illustrated in FIGS. 2 and 3 produce good quality edges along the slots without creating nearly as much dust as a rotating abrasive disc, but these blades nonetheless produce a small amount of dust that sticks to the shake-panels and subsequently fouls the painting equipment used to pre-paint the shake-panels. Therefore, PacTool International also sought to develop an improved cutting machine that could produce fiber-cement shake-panels suitable for pre-painting operations.

DETAILED DESCRIPTION

Figure 1:
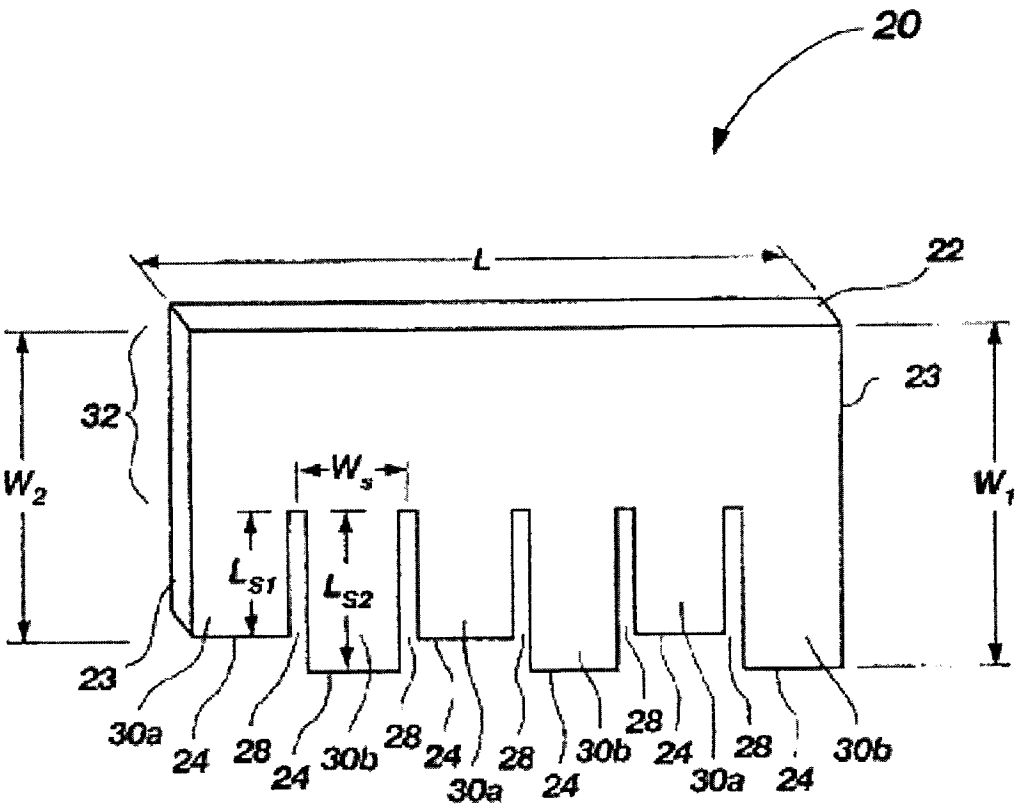
FIG. 1 (Prior Art)
FIG. 1 is an isometric view of a prior art fiber-cement shake-panel.
Figure 2:
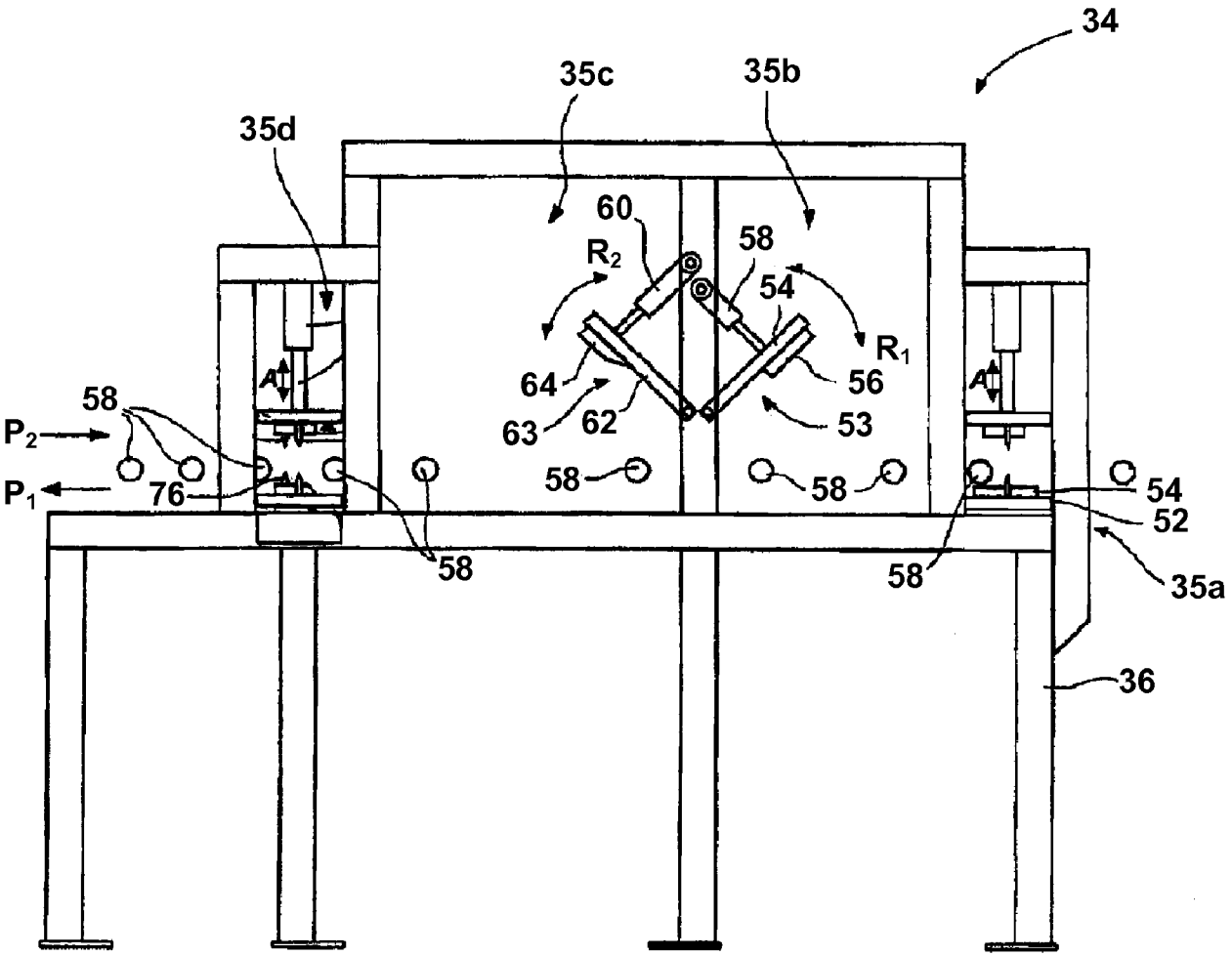
FIG. 2 (Prior Art)
FIG. 2 is a side view of a prior art cutting machine for forming the shake-panel of FIG. 1 from cured fiber-cement panels and/or planks.
Figure 3:
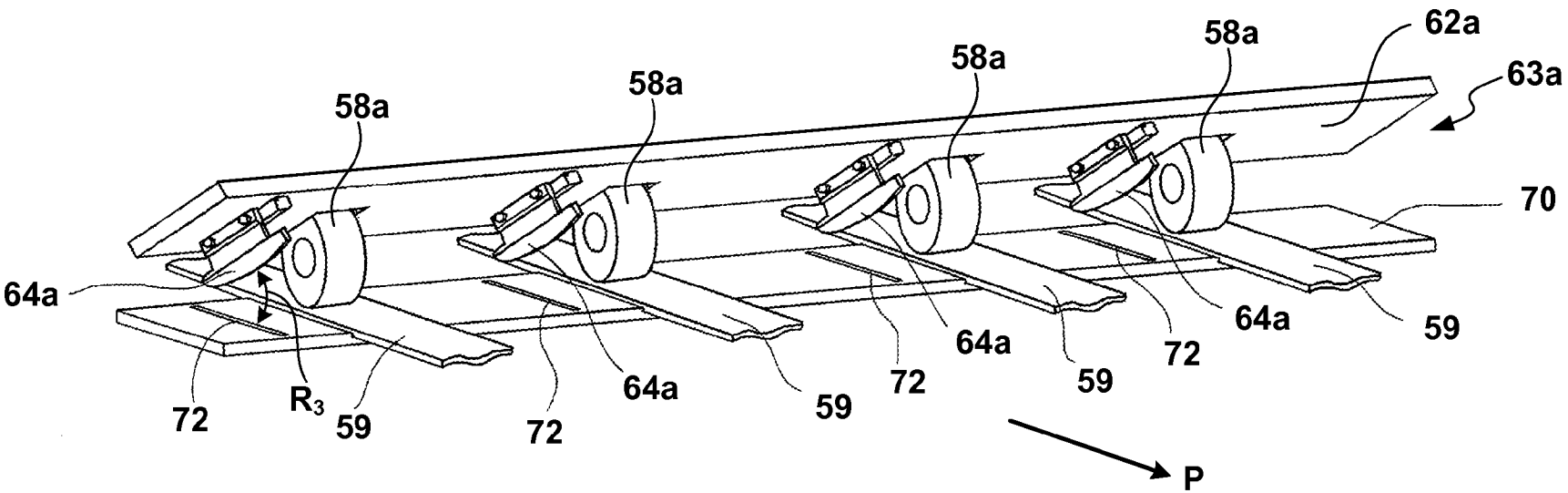
FIG. 3 (Prior Art)
FIG. 3 is an isometric view of a prior art slot cutting assembly for forming slots in cured fiber-cement planks or panels.

The following disclosure describes cutting machines and methods for cutting cured fiber-cement materials to form shake-panels or other fiber-cement products. Many specific details of certain embodiments are set forth in the following description and in FIGS. 4A-6 to provide a thorough understanding of such embodiments. One skilled in the art, however, will understand that the invention may have additional embodiments, or that the invention may be practiced without several of the details described below. In the figures and description that follow, like elements and features are identified by like reference numerals. Additionally, the sizes and relative positions of elements in the drawings may not necessarily be drawn to scale. For example, unless otherwise expressly described in the text, the shapes, angles or dimensions of various elements are not drawn to scale, and some of these elements are arbitrarily enlarged to improve the legibility of the drawings. Further, unless expressly stated in the text, the particular shapes of the elements as drawn are not intended to convey any information regarding the actual shape of the particular elements, and have been selected for ease and recognition throughout the figures.

Reference throughout this specification to "one example," "an example," "one embodiment," or "an embodiment" means that a particular feature, structure, or characteristic described in connection with the example or embodiment is included in at least one example of the present technology. Thus, occurrences of the phrases "in one example," "in an example," "one embodiment," or "an embodiment" in various places throughout this specification are not necessarily all referring to the same example or embodiment. Furthermore, the particular features, structures, routines, steps, or characteristics may be combined in any suitable manner in one or more examples or embodiments of the technology. The headings provided herein are for convenience only and are not intended to limit or interpret the scope or meaning of the claimed technology.

Figure 4A:
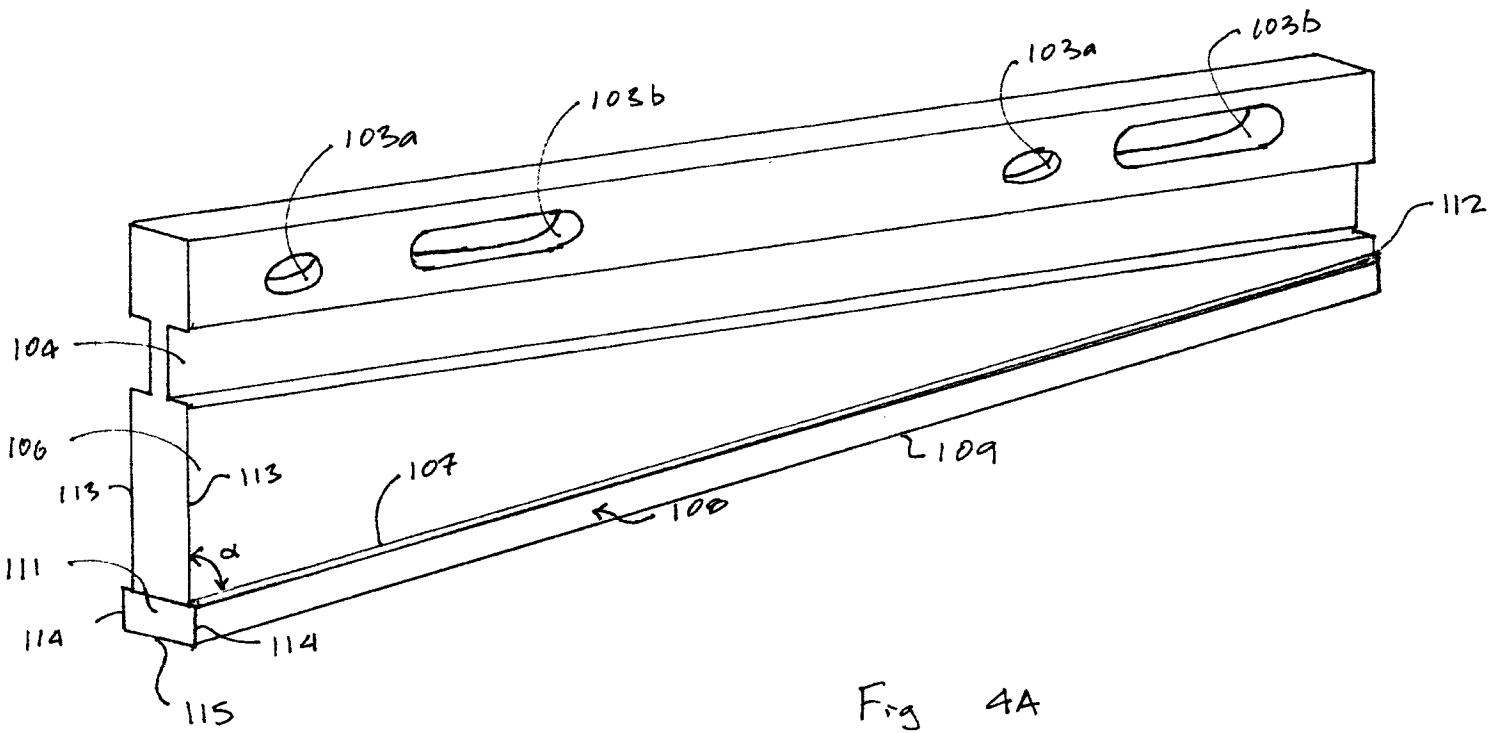
FIG. 4A is an isometric view of a cutting blade or knife for cutting slots in cured fiber-cement panels and/or planks in the manufacturing of fiber-cement shake-panels in accordance with an embodiment of the disclosure.

FIG. 4A is an isometric view of a cutting blade 100 in accordance with an embodiment of the technology. In this embodiment, the cutting blade 100 includes a head 102 having holes 103*a* and slots 103*b* configured to reversibly attach the blade 100 to a blade mount as explained in more detail below with reference to FIG. 5. The cutting blade 100 further includes a channel 104 and a shank 106. The channel 104 is thinner than the shank 106 so that the blade 100 does not contact the workpiece when the blade 100 is in a lowered position. The shank 106 further includes an inclined edge 107 that extends at an angle $\alpha$ relative to an axis parallel to a cutting path S. The cutting blade 100 can optionally include a hardened cutting element 108 either attached to or integral with the shank 106. The cutting element 108 has a cutting edge 109 inclined at the angle $\alpha$ and extending at the angle $\alpha$ all the way from a first end 111 to a second end 112. The cutting element 108 can also have a piercing portion 115, such as a sharp tip or edge, at the lowermost extent of the cutting edge 109 and sidewalls 114. In other embodiments, the cutting edge 109 can be at the inclined edge of the shank 106, and thus the cutting edge 109 can have sidewalls defined by either the sidewalls of the cutting element 108 or the sidewalls of the shank 106 depending on which of these features initially engages the workpiece W.

Figure 4B:
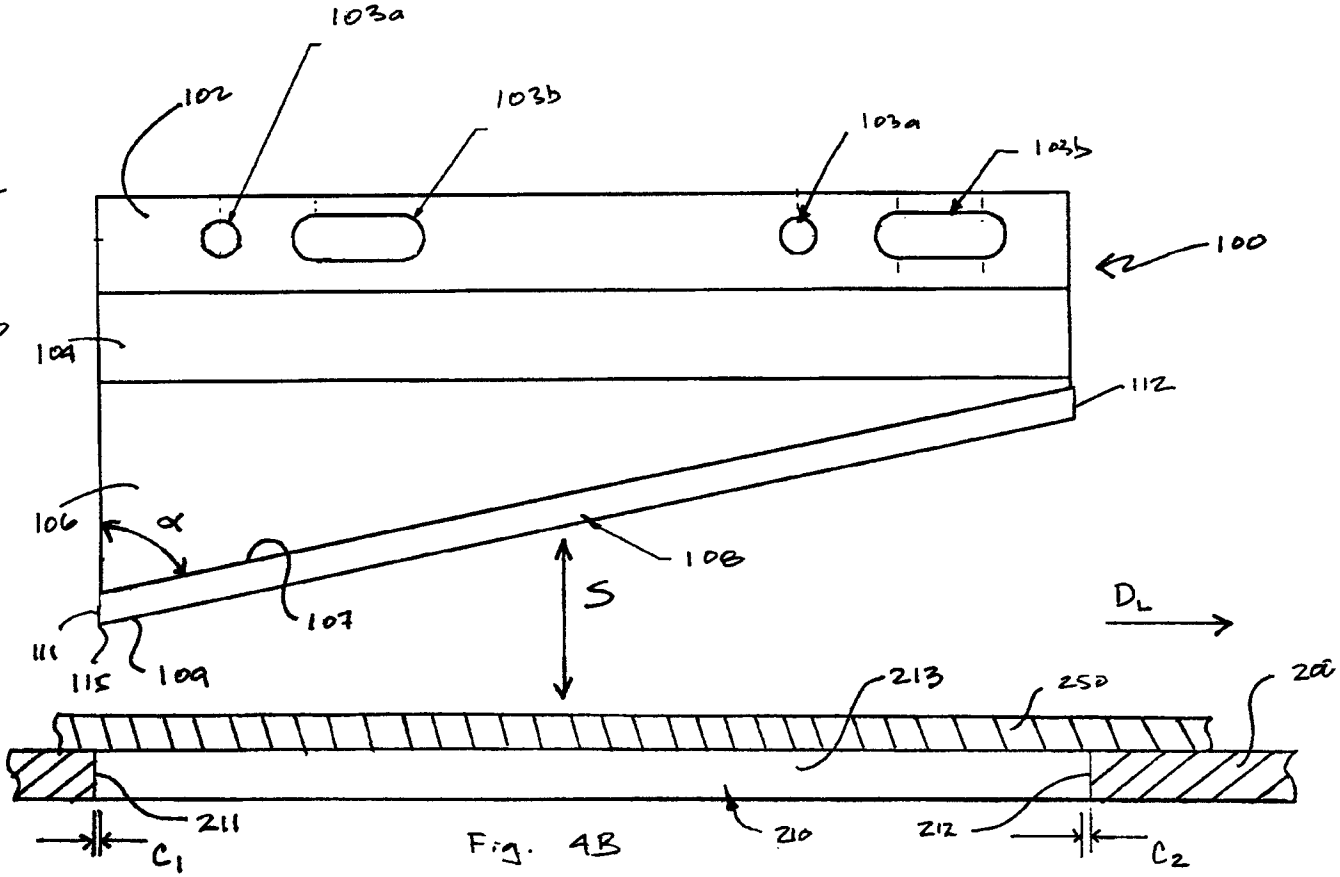
FIG. 4B is a side view of the cutting blade of FIG. 4A and an anvil plate of a fiber-cement cutting machine in accordance with an embodiment of the disclosure.
Figure 4C:
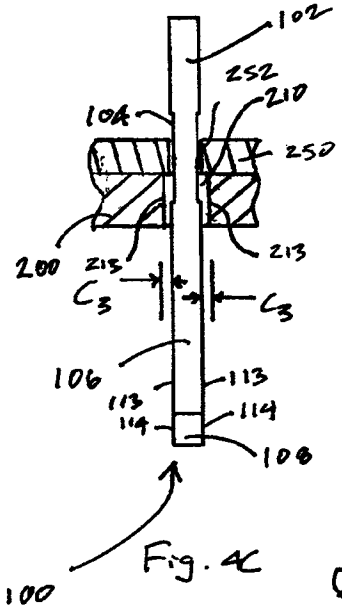
FIG. 4C is an end view of the cutting blade and anvil plate shown in FIG. 4B.
Figure 4D:
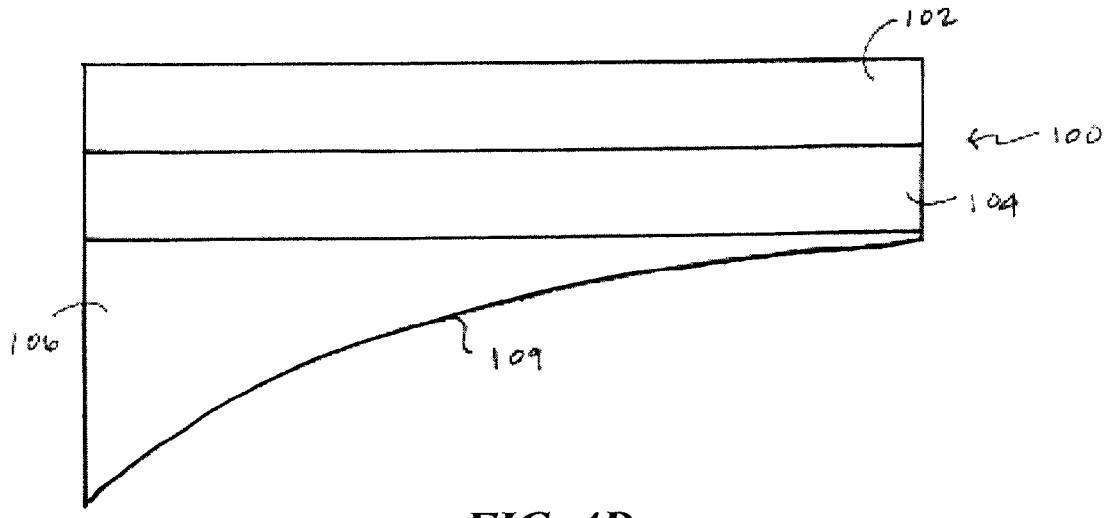
FIGS. 4D-4G are side views of cutting blades in accordance with other embodiments of the technology.
Figure 4E:
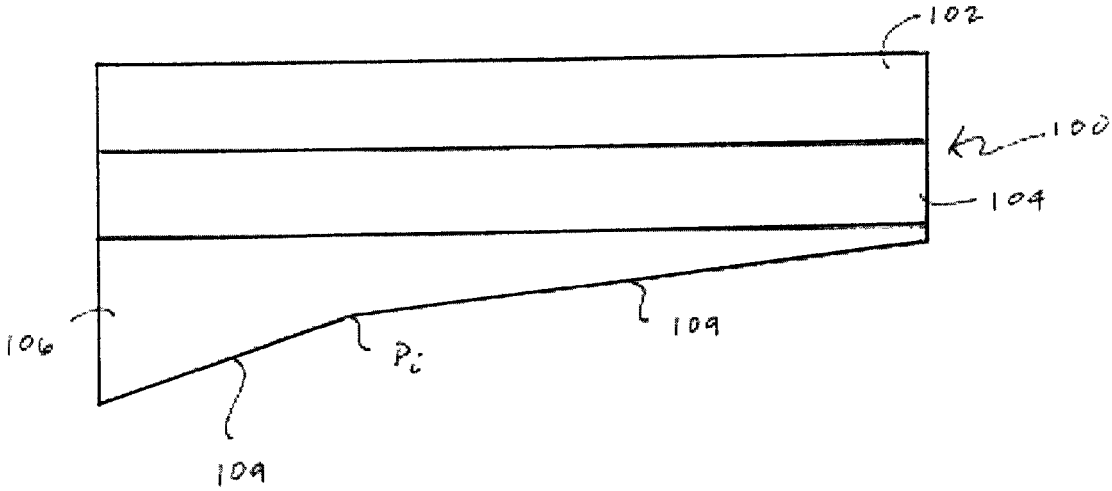

FIGS. 4B and 4C are side and end views, respectively, of the cutting blade 100, an anvil plate 200, and a fiber-cement workpiece 250. FIGS. 4A and 4B further illustrate the operation of the cutting blade 100 to form a slot 252 (FIG. 4C) in the fiber-cement workpiece 250 by moving the cutting blade 100 along a straight cutting path S between a raised position and a lowered position. Referring to FIG. 4B, the blade 100 is in the raised position above the anvil plate 200 and aligned with a slot 210 in the anvil plate 200. The slot 210 includes a first end wall 211 having a first clearance $C_1$ relative to the first end 111 of the cutting element 108 (e.g., the first end of the cutting edges 109) and a second end wall 212 having a clearance $C_2$ relative to the second end 112 of the cutting element 108 (e.g., the second end of the cutting edges 109). Referring to FIG. 4C, the slot 210 in the anvil plate 200 can further include sidewalls 213 having a clearance $C_3$ relative to sidewalls 113 of the shank 106 and/or sidewalls 114 of the cutting element 108.

In operation, a fiber-cement workpiece 250 is positioned under the blade 100 and over the slot 210 when the blade 100 is in the raised position shown in FIG. 4B. An actuator (not shown in FIGS. 4A and 4B) drives the blade 100 downward so that the piercing portion 115 of the cutting element 108 pierces the fiber-cement workpiece 250 and the cutting edge 109 slices through the workpiece along the longitudinal dimension of the slot 210 to form the slot 252 in the workpiece W. Referring to FIG. 4C, the blade 100 moves downwardly along the straight cutting path S until the channel 104 is aligned with workpiece 250. The workpiece 250 can then be moved in a direction $D_L$ along the longitudinal dimension of the slot 210 until the workpiece 250 clears the blade 100. The blade 100 is then raised along the straight path S to the raised position illustrated in FIG. 4B to cut another workpiece. The channel 104 enables the workpiece W to be removed from the cutting area and the blade 100 to be raised to the raised position without passing the shank 106 or cutting element 108 upwardly through the slot 252 formed in the workpiece W. This eliminates delamination that could otherwise be caused by moving the cutting element 108 or shank 106 upwardly through the slot 252.

In a specific embodiment of the blade 100 illustrated in FIGS. 4A-C, the angle $\alpha$ is from approximately 83.5° to approximately 85°. Although this angle is relatively shallow with respect to the surface of the workpiece 250, it produced a much cleaner cut with far fewer cracks along the cut slot 252 compared to a test blade having an angle $\alpha$ of 78°. Using an angle $\alpha$ of approximately 83.5° to approximately 85° also produced less dust compared to blades with lower angles (i.e., steeper incline relative to the surface of the workpiece 250).

The embodiment of the blade 100 having an angle α of approximately 83.5° to approximately 85° is accordingly well-suited for cutting slots in fiber-cement workpieces to form shake-panels that are prepainted at a manufacturing facility before being shipped to a distributor.

A specific embodiment of the blade 100 and the anvil plate 200 shown in FIGS. 4A-C has end clearances $C_1$ and/or $C_2$ of approximately 0.005-0.015 inch and side clearances $C_3$ on each side of approximately 0.008-0.020 inch. The end clearances $C_1$ and $C_2$ are preferably 0.010 inch for cured fiber-cement workpieces that have a low moisture content and a nominal thickness of 0.25 inch. The side clearances $C_3$ between the sidewalls 114 of the cutting element 108 are preferably 0.015-0.018 inch, and in particular 0.017 inch, for cutting a cured fiber-cement workpiece having a low moisture content and a nominal thickness of 0.25 inch. The end clearance of 0.010 inch and the side clearance of 0.17 inch provide excellent edge quality along the slot 252 formed in a cured fiber-cement workpiece with a nominal thickness of 0.25 inch that further enhances the appearance and reduces the amount of dust. Even a modest difference in the side clearance $C_3$ to 0.020 inch causes a significant degradation of edge quality along the slot 252 that may render the shake-panels with such slots unsuitable for prepainting.

Figure 4F:
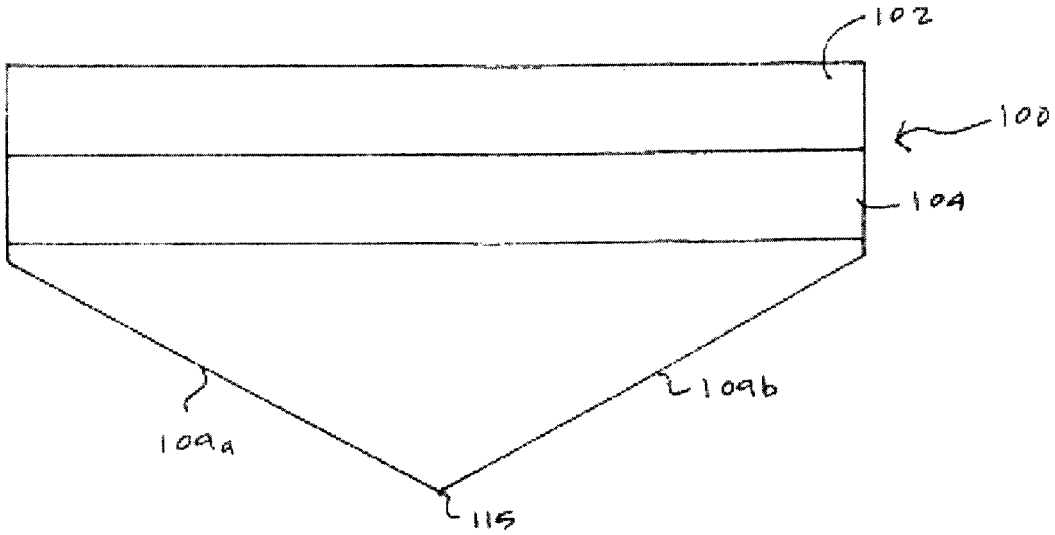
Figure 4G:
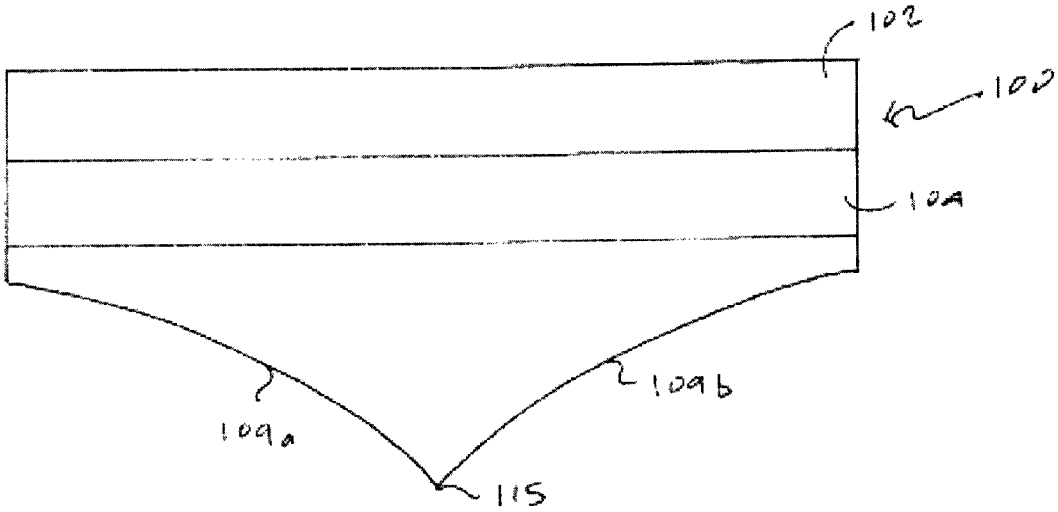

FIGS. 4D-4G illustrate additional embodiments of cutting blades 100. As opposed to the cutting edge 109 extending at the angle α all the way from the first end 111 to the second end 112 as shown in FIGS. 4A-4C, other embodiments of the cutting edge 109 can be curved and or extend at a different angle for a portion of its length. For example, the cutting edge 109 can have a single curve of either a single radius or more generally a compound radius (shown in FIG. 4D), or the cutting edge 109 can extend at a first angle from the first end 111 to an intermediate point $P_i$ and then a second angle from the intermediate point $P_i$ to the second end 112. FIGS. 4F and 4G show cutting blades 100 with double cutting edges 109*a* and 109*b* that extend from a piercing portion 115 located between the first and second ends 111 and 112. In FIG. 4F the double cutting edges 109*a* and 109*b* are straight edges, whereas in FIG. 4G the double cutting edges 109*a* and 109*b* are curved. The cutting element 108 is optional, and thus the cutting edges 109, 109*a* and 109*b* shown in FIGS. 4A-4G can be part of the shank 106 as shown in FIGS. 4D-4G or the cutting element 108 attached to the shank 106 as shown in FIGS. 4A-4C.

Figure 5:
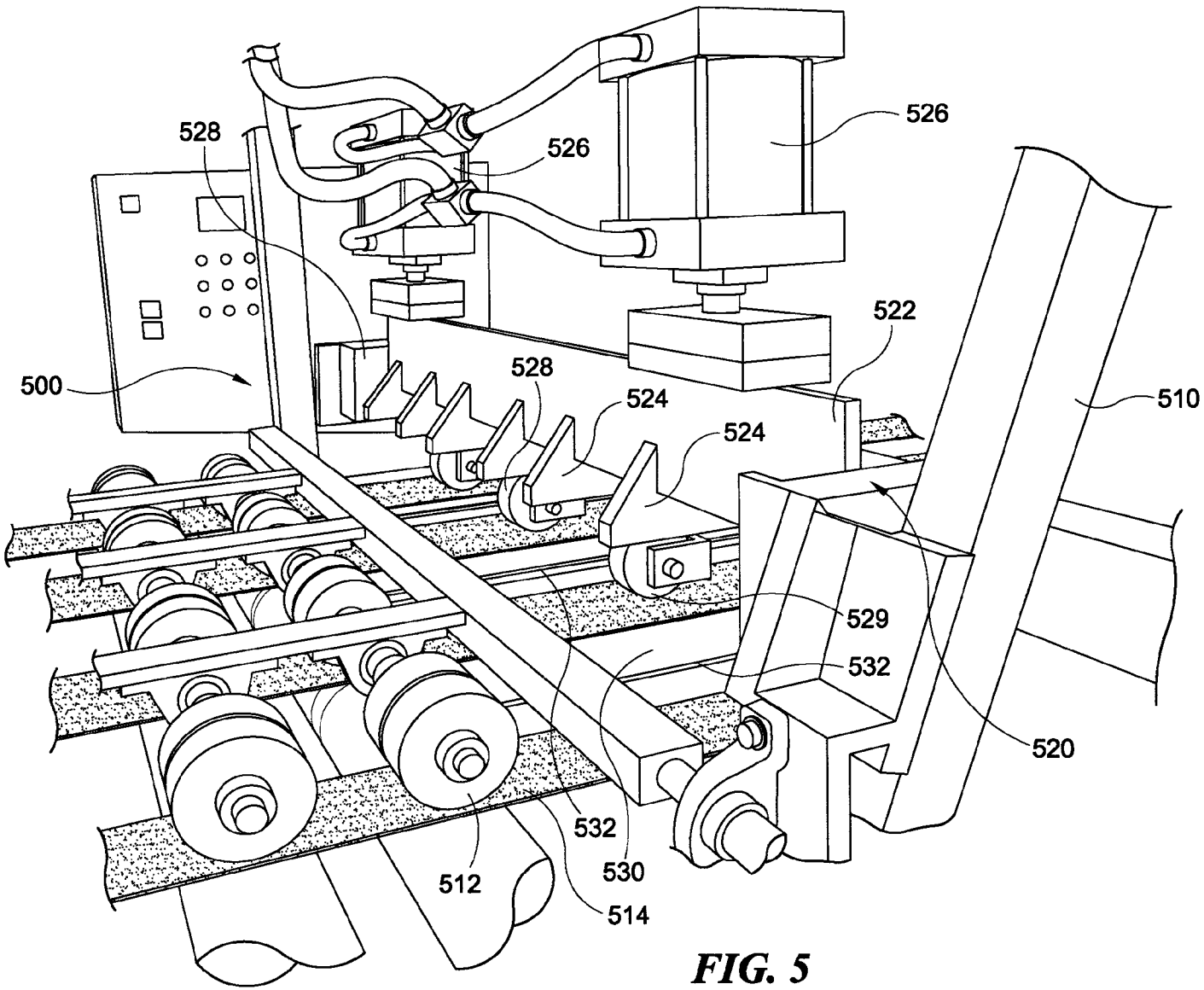
FIG. 5 is an isometric view of a cutting machine for, forming fiber-cement shake-panels in accordance with an embodiment of the disclosure.

FIG. 5 is an isometric view illustrating a cutting machine 500 for forming fiber-cement shake-panels or other fiber-cement products from cured, low moisture content fiber-cement planks and panels. The cutting machine 500 includes a frame 510, a plurality of rollers 512 and belts 514 that individually and/or together drive a workpiece through the cutting machine 500, and a cutting assembly 520. The cutting assembly illustrated in FIG. 5 includes a cross member 522, blade mounts 524 projecting from the cross member 522, actuators 526 attached to the cross member 522, and end guides 528 that guide the cross member 522 along a straight path S. The cutting assembly 520 can further include press down rollers 529 that move with the cross member 522 and blade mounts 524. The cutting machine 500 can further include an anvil plate 530 having a plurality of slots 532 corresponding to the blade mounts 524. The blades are not mounted to the blade mounts 524 in the embodiment of the cutting machine 500 illustrated in FIG. 5. In operation, the actuators 526 drive the cross member 522 downwardly along the straight path S between a raised position and a lowered position.

Figure 6:
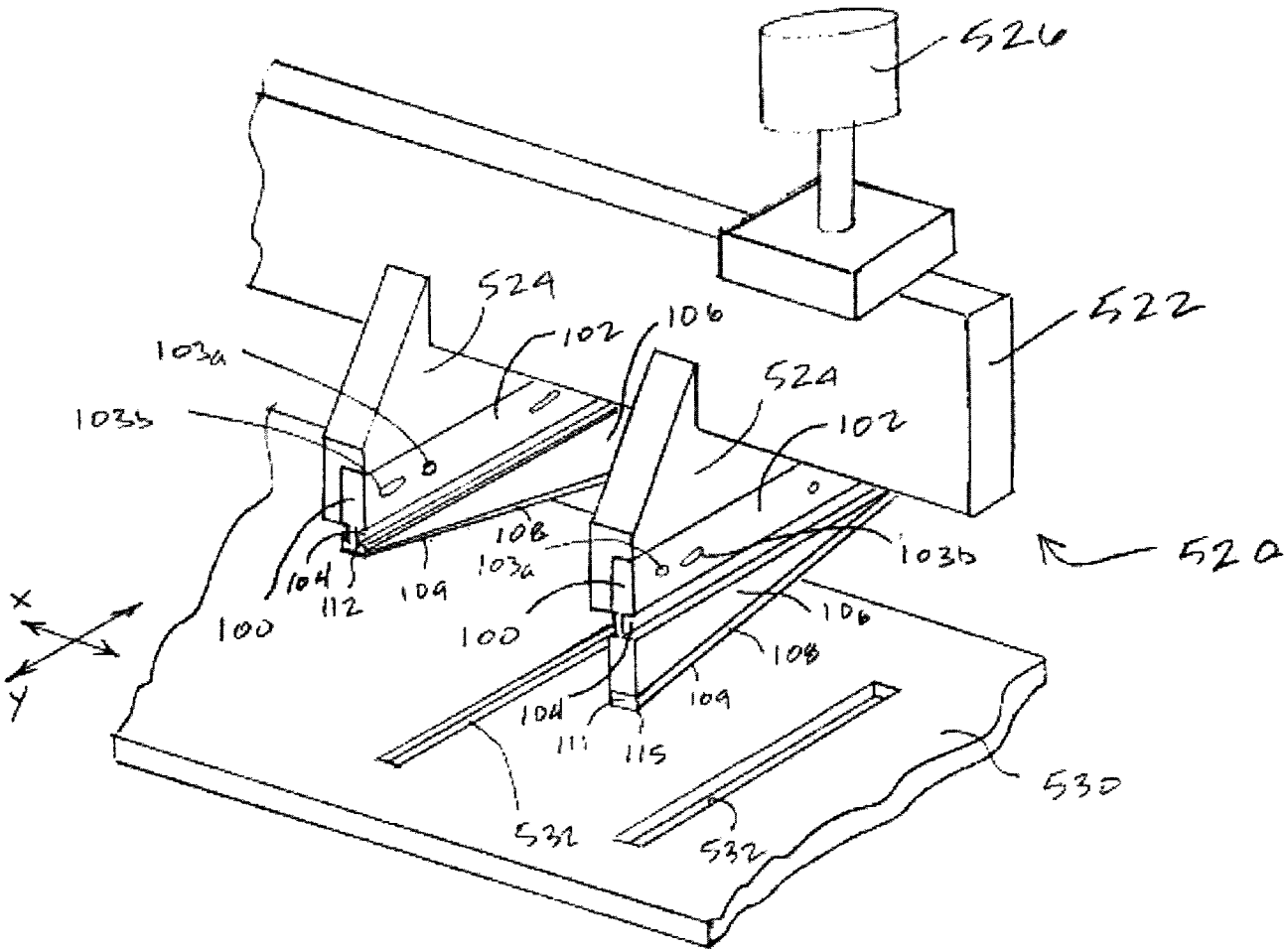
FIG. 6 is an isometric view showing a portion of the cutting machine of FIG. 5 in more detail.

FIG. 6 is an isometric view illustrating a portion of the cutting assembly 500 illustrated in FIG. 5 with an embodiment of the blades 100 illustrated in FIGS. 4A-C. In the embodiment illustrated in FIG. 6, the blades 100 are mounted to the blade mounts 524 such that the first end 111 of the cutting element 108 of one blade and the second end 112 of the cutting element 108 of the another blade face in the same direction. As a result, the cutting edges 109 of the two blades project downwardly in opposite directions along the Y-axis. This configuration of attaching the blades 100 to the blade mounts 524 causes equal and opposite forces along the Y-axis as the blades 100 move through the fiber-cement workpiece, which inhibits the workpiece from moving along the Y-axis during the cutting process. This becomes more important with the close tolerances between the cutting element 108 and the slots 532. In other embodiments, the blades 100 can be attached to the blade mounts 524 such that the cutting edges 109 all slope downwardly in the same direction relative to the Y-axis. In still a different embodiment, blades that are not adjacent to each other can be mounted in a reverse configuration similar to the embodiment illustrated in FIG. 6.

The blades 100 can be attached to the blade mounts 524 using shims to adjust the position of the blades 100 along the X-axis. This allows the blades 100 to be accurately aligned with corresponding slots 532 in the anvil plate 530 within the tight tolerances required to cut the fiber-cement panels and planks in a highly dust-free manner. Moreover, the combination of the holes 103*a* and slots 103*b* in the head 102 of each blade 100 enables the blades 100 to be attached the blade holders 524 in either the forward or reversed position relative to the Y-axis. The slots 103*b* further allow adjustment along the Y-axis to aligned the ends of the blades 100 with the ends of the slots 532 in the anvil plate 530.

The blades 100 illustrated in FIG. 6 also provide good, square corners at the closed or blind end of the slots cut through the workpiece. By providing a hard, sharp cutting element 108 that can withstand the abrasiveness of cured fiber-cement, the closed end of the slots can have highly squared corners. This improves the appearance of the slots and appears to reduce the particles or dust that remain on the workpiece after passing through the cutting machine.

From the foregoing, it will be appreciated that specific embodiments of the invention have been described herein for purposes of illustration, but that various modifications may be made without deviating from the spirit and scope of the invention. For example, although the blades and cutting assemblies described above are very well suited for cutting slots in cured, low moisture fiber-cement panels, they can also be used to form slots in uncured or partially cured pieces of fiber-cement that have higher moisture content. Accordingly, the invention is not limited except as by the appended claims.

What is claimed is:

1. A cutting machine for cutting slots in fiber-cement workpieces, comprising:

an anvil plate having a plurality of slots, wherein individual slots have sidewalls and end walls;

a drive system for moving a fiber-cement workpiece over the anvil plate along a drive path;

a cross member above the anvil plate, wherein the cross member extends transverse to the drive path along which the workpiece travels;

an actuator coupled to the cross member, wherein the actuator moves the cross member along a straight path between a raised position and a lowered position;

a plurality of blade mounts along the cross member at locations corresponding to the slots in the anvil plate; and a plurality of cutting blades, wherein individual cutting blades comprise a head configured to be attached to a corresponding blade mount, a shank projecting downwardly relative to the head, and a cutting edge extending at an angle of approximately 83.5° to 85° relative to an axis parallel to the straight path along which the blade moves to cut slots in the fiber-cement workpiece.

2. The cutting machine of claim 1 wherein one blade is mounted to a blade mount such that the cutting edge extends downwardly in one direction relative to the drive path of the workpiece and another blade is mounted to another blade mount such that the cutting edge extends downwardly in an opposite direction relative to the drive path of the workpiece.

3. The cutting machine of claim 1 wherein each cutting blade further comprises a hardened cutting element attached to a lower portion of the shank, and the cutting edge is a lower edge of the cutting element.

4. The cutting machine of claim 1 wherein each cutting blade further comprises a cutting element comprising a carbide edge.

5. The cutting machine of claim 1 wherein each cutting blade further comprises a channel between the head and the shank, wherein the channel is thinner than the shank.

6. The cutting machine of claim 5 wherein a clearance between the end walls of each slot in the anvil plate and ends of corresponding cutting edges is approximately 0.005-0.015 inch.

7. The cutting machine of claim 5 wherein a clearance between the end walls of each slot in the anvil plate and ends of corresponding cutting edges is approximately 0.010 inch.

8. The cutting machine of claim 5 wherein a clearance between the sidewalls of each slot in the anvil plate and sidewalls of corresponding cutting edges is between 0.008-0.020 inch, exclusive of 0.020 inch.

9. The cutting machine of claim 5 wherein a clearance between the sidewalls of each slot in the anvil plate and sidewalls of corresponding cutting edges is approximately 0.017 inch.

10. The cutting machine of claim 1 wherein the cutting edge has a first end, a second end, and a piercing portion at the first end.

11. The cutting machine of claim 1 wherein the first end is the lowermost end of the cutting edge.

12. A cutting machine for cutting slots in fiber-cement workpieces, comprising:

an anvil plate having a plurality of slots, wherein individual slots have sidewalls and end walls;

a drive system for moving a fiber-cement workpiece over the anvil plate along a drive path;

a cross member above the anvil plate, wherein the cross member extends transverse to the drive path along which the workpiece travels;

an actuator coupled to the cross member, wherein the actuator moves the cross member along a straight path between a raised position and a lowered position;

a plurality of blade mounts along the cross member at locations corresponding to the slots in the anvil plate; and a plurality of cutting blades, wherein individual cutting blades comprise a head configured to be attached to a corresponding blade mount, a shank projecting downwardly relative to the head, and a cutting edge extending at an angle relative to an axis parallel to the straight path along which the blade moves to cut slots in the fiber-cement workpiece, and wherein the cutting edge has a first end, a second end, and a sharp piercing portion at the lowermost point of the cutting edge.

13. The cutting machine of claim 12 wherein the piercing portion is located at the first end of the cutting edge.

14. The cutting machine of claim 13 wherein the cutting edge extends at an angle of approximately 83.5° to approximately 85° relative to the axis parallel to the straight path along which the cutting blade moves to cut the slots.

15. The cutting machine of claim 14 wherein a clearance between the end walls of each slot in the anvil plate and the first and second ends of each cutting edge is from approximately 0.005-0.015 inch.

16. The cutting machine of claim 14 wherein a clearance between the end walls of each slot in the anvil plate and the first and second ends of each cutting edge is approximately 0.010 inch.

17. The cutting machine of claim 14 wherein a clearance between the sidewalls of each slot in the anvil plate and sidewalls of each cutting edge is between 0.008-0.020 inch, exclusive of 0.020 inch.

18. The cutting machine of claim 14 wherein a clearance between the sidewalls of each slot in the anvil plate and sidewalls of each edge is approximately 0.017 inch.

* * * * *